US005926917A

United States Patent [19]

Gantz

[11] Patent Number: 5,926,917

[45] Date of Patent: Jul. 27, 1999

[54] DOOR HINGE ASSEMBLY

[75] Inventor: Martin L. Gantz, Livonia, Mich.

[73] Assignee: Dura Automotive Systems, Inc., Rochester Hills, Mich.

[21] Appl. No.: 09/048,361

[22] Filed: Mar. 26, 1998

[51] Int. Cl.[6] ..... E05D 11/10

[52] U.S. Cl. ..... 16/334; 16/286; 16/335; 16/327

[58] Field of Search ..... 16/286, 290, 334, 16/335, 257, 274, 261, 263, 264, 327

[56] References Cited

U.S. PATENT DOCUMENTS

| | | | |
|---|---|---|---|
| 2,990,569 | 7/1961 | Pollak | 16/286 |
| 2,992,451 | 7/1961 | Schonitzer et al. | 16/286 |
| 3,065,497 | 11/1962 | Faber | 16/142 |
| 3,594,853 | 7/1971 | Slattery | 16/163 |
| 3,729,772 | 5/1973 | Marchione | 16/145 |
| 3,870,361 | 3/1975 | Krause | 296/146 |
| 4,236,272 | 12/1980 | Gronbach et al. | 16/286 |
| 4,446,596 | 5/1984 | Arlauskas | 16/334 |
| 4,672,715 | 6/1987 | Beckwith | 16/334 |
| 4,720,895 | 1/1988 | Peebles | 16/264 |
| 4,765,025 | 8/1988 | Salazar | 16/285 |
| 4,807,331 | 2/1989 | Calucci | 16/262 |
| 4,864,687 | 9/1989 | Calcaterra et al. | 16/237 |
| 4,864,689 | 9/1989 | Brockhaus | 16/262 |
| 4,881,298 | 11/1989 | Turnbull | 16/266 |
| 5,029,364 | 7/1991 | Salazar | 16/382 |
| 5,054,165 | 10/1991 | Marchione | 16/334 |
| 5,067,201 | 11/1991 | Marchione | 16/374 |
| 5,173,991 | 12/1992 | Carswell | 16/86 A |
| 5,297,314 | 3/1994 | Bender et al. | 16/270 |
| 5,570,498 | 11/1996 | Hipkiss et al. | 16/334 |
| 5,632,065 | 5/1997 | Siladke et al. | 16/335 |
| 5,644,817 | 7/1997 | Bender et al. | 16/382 |
| 5,675,869 | 10/1997 | Lotz | 16/334 |

*Primary Examiner*—Chuck Y. Mah
*Attorney, Agent, or Firm*—Banner & Witcoff, Ltd.

[57] ABSTRACT

A hinge assembly for the door of a motor vehicle is disclosed, the hinge assembly having a body half strap having a top flange and a bottom flange, with the top flange having at least one slot, a door half strap pivotable with respect to the body half strap and having a top flange and a bottom flange, the top flange having an external profile having at least a pair of detents. A linearly slidable profile follower assembly is biased by a compression spring and can travel along the slot toward and away from the door half strap in response to pivoting of the door half strap. The linearly slidable profile follower assembly comprises a spring retainer clip, a roller retainer clip and a roller. The roller is mounted on the roller retainer clip, and is in continuous direct engagement with the external profile of the door half strap as the door half strap pivots with respect to the body half strap. The spring retainer clip is secured to the roller retainer clip by a pin extending through the slot on the top flange of the body half strap. The profile follower assembly.

11 Claims, 3 Drawing Sheets

DOOR HINGE ASSEMBLY

FIELD OF THE INVENTION

The present invention generally relates to a new and improved hinge assembly for securing a pivoting member relative to a fixed member, and more particularly to hinging devices for pivotally securing a door to a motor vehicle.

BACKGROUND OF THE INVENTION

Hinges are used on motor vehicle doors to allow the door to pivot with respect to a main body of the motor vehicle, allowing ingress and egress of passengers and objects to and from the interior of the motor vehicle. Construction of such hinges normally includes a door half or strap which is bolted to a motor vehicle door, and a body half or strap which is bolted to the structural frame or main body of a motor vehicle. The door half is pivotable with respect to the body half, and may have a profile on one edge, often with a series of detents. One example of such a hinge assembly includes a relatively large torsion bar or Z-spring which can be mounted on the body half. The Z-spring typically has a main body section providing a primary axis about which a flange of the spring can flex. Ordinarily the flange extends toward the profile. A roller is mounted, for example, over the Z-spring such that when the body half is assembled to the door half the roller is biased by the Z-spring into engagement with the profile. Opening a door causes the door half to rotate, partially overcoming the force of the Z-spring. The profile typically does not form an arc of uniform length from the main axis of the Z-spring (especially at the detents). Therefore, as the door half pivots, the Z-spring flange yields slightly in a arcuate motion around its main axis to accommodate the irregular distance between the main axis and the profile. A problem with this kind of design is that the relatively large size of the Z-spring makes it difficult to weld or bolt the door and body halves of the hinge assembly to the corresponding door and main body. It would be highly desirable to provide a hinge assembly which allows for easy welding of the door half and the body half.

In view of the foregoing, it is an object of the present invention to provide a hinge assembly which is easy to assemble and particularly having improved attachment characteristics. It is another object of the present invention to provide a hinge assembly of simple construction having a doors-off feature and an integral check. It is yet another related object of the present invention to provide a hinge assembly that is highly reliable in operation.

SUMMARY OF THE INVENTION

In accordance with these and other objects, there is provided a hinge assembly comprising a body half assembly, a door half assembly, a profile follower assembly linearly slidable on the body half assembly, and a compression spring biasing the profile follower assembly towards the door half assembly. The body half assembly comprises a preferably C-shaped body half strap and is provided with a slot, and the door half assembly has a door half strap which is pivotable with respect to the body half strap. The door half strap has an external profile having at least a pair of detents. The profile follower assembly preferably comprises a spring retainer clip, a roller retainer clip and a roller mounted on the roller retainer clip, and the spring retainer is secured to the roller retainer clip by a pin extending through the slot on the body half strap. The compression spring biases the profile follower assembly so that the roller is in continuous direct engagement with the external profile of the door half strap as the door half strap pivots with respect to the body half strap. In certain preferred embodiments a pair of slots may be used, each positioned on either side of the compression spring and aligned generally parallel with one another and with the compression spring.

From the foregoing disclosure and the following more detailed description of various preferred embodiments it will be apparent to those skilled in the art that the present invention provides a significant advance in the technology and art of hinge assemblies. Particularly significant in this regard is the potential the invention affords for increasing access for welding the body half strap and the door half strap to the corresponding motor vehicle body and door. Additional features and advantages of various preferred embodiments will be better understood in view of the detailed description provided below.

Figure 1:
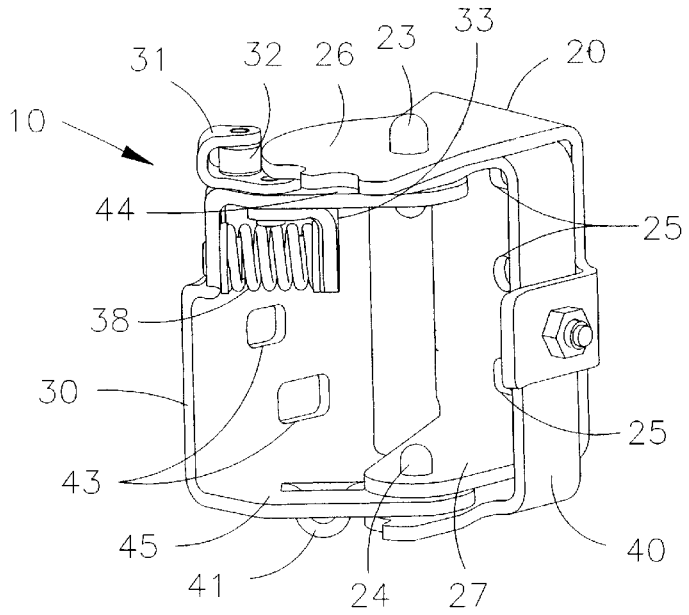
FIG. 1 is a perspective view of a hinge assembly for a motor vehicle door in accordance with a preferred embodiment, shown in a closed position.

It should be understood that the appended drawings are not necessarily to scale, presenting a somewhat simplified representation of various preferred features illustrative of the basic principles of the invention. The specific design features of a hinge assembly as disclosed here, including, for example, specific dimensions of the spring, the diameter of the roller,and the shape of the detents, will be determined in part by the particular intended application and use environment. Certain features of the illustrated embodiments have been enlarged or distorted relative to others to facilitate visualization and clear understanding. In particular, thin features may be thickened, for example, for clarity of illustration. All references to direction and position, unless otherwise indicated, refer to the orientation of the hinge assembly as illustrated in the drawings.

DETAILED DESCRIPTION OF CERTAIN PREFERRED EMBODIMENTS

It will be apparent to those skilled in the art, that is, to those who have knowledge or experience in this area of technology, that many uses and design variations are possible for the hinge assembly disclosed here. The following detailed discussion of various alternative and preferred features and embodiments will illustrate the general principles of the invention with reference to a hinge assembly for use in an automotive vehicle door. Other embodiments suitable for other applications, such as recreational vehicles and trucks, will be apparent given the benefit of this disclosure.

Referring now to the drawings, FIG. 1 is perspective view of a hinge assembly 10 for a motor vehicle door shown in a closed position. That is, the hinge assembly 10 is shown as it would appear when the door is closed. The hinge assembly is seen to comprise a door half strap 20 and a body half strap 30. The door half strap 20 is attached to a door at, for example, openings 25, which can either be through holes for receiving a bolt or fill holes for placing a weld. Similarly, the body half strap 30 has openings 43 for attachment to a main body or structural frame of a motor vehicle.

Figure 2:
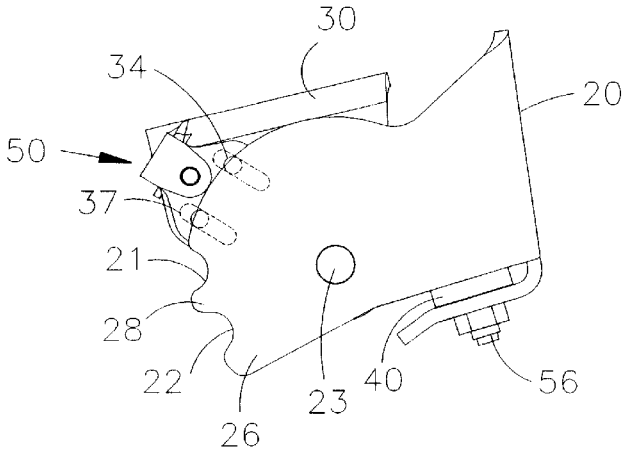
FIG. 2 is a top view of the hinge assembly of FIG. 1.
Figure 3:
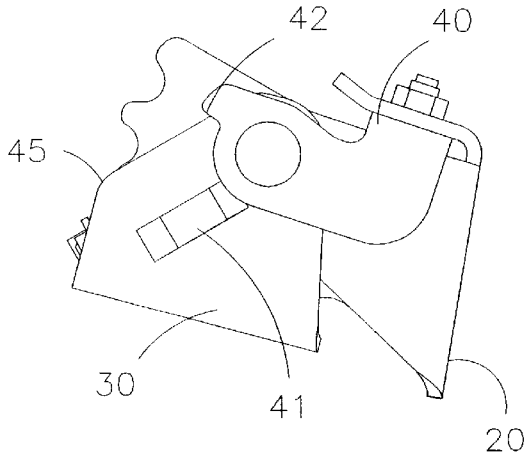
FIG. 3 is a bottom view of the hinge assembly of FIG. 1.

The door half strap 20 is pivotable with respect to the body half strap 30 over upper hinge pin 23 and lower hinge pin 24. Pins 23 and 24 are coaxial and spaced apart, allowing for an opening between them. It will be readily apparent to those skilled in the art given the benefit of this disclosure that a single pin could be used if desired instead of the upper and lower hinge pins 23, 24 disclosed in the drawings. The door half strap 20 is generally C-shaped, having a top flange 26 (see FIG. 2, a top view) and a bottom flange 27 (see FIG. 3, a bottom view). Body half strap 30 may also be generally C-shaped, and have a top flange 44 and a bottom flange 45. The top flange 26 of the door half has an external profile 28 which is generally arc-shaped with at least a pair of detents 21, 22. The detents 21, 22 acts as integral checks for the hinge assembly, allowing the hinge assembly 10 to temporarily hold a door in a particular position.

Figure 7:
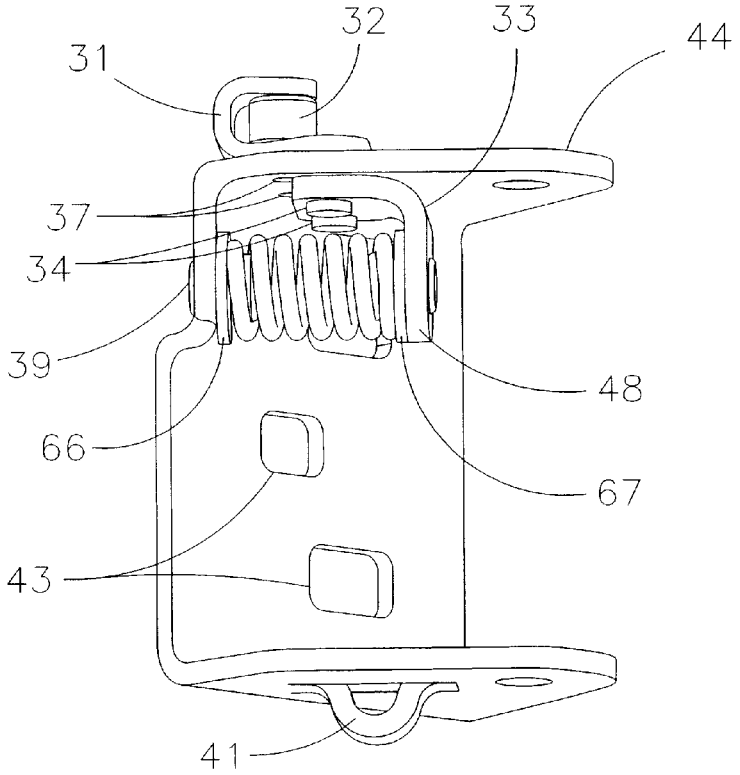
FIG. 7 is a perspective view of the hinge assembly of FIG. 1 with the door half strap removed for clarity of illustration, showing the profile follower assembly.

The top flange 44 of the body half has at least one slot 37, and in the embodiment shown in the drawings, two slots which are aligned generally parallel with one another and with a compression spring 38. Profile follower assembly 50 comprises a roller retainer clip 31 positioned on the top of the top flange 44 of the body half strap 30, and a spring retainer clip 33 positioned below the top flange 44. The roller retainer clip 31 and the spring retainer clip 33 are rigidly connected by at least one pin 34 through a slot 37 to transmit the spring force. (The slots are best viewed in FIG. 7, where the door half strap 20 has been removed for clarity of illustration.) In the embodiment shown in the drawings, a pair of pins 34 are used, each positioned in a corresponding slot 37. The slots 37 provide a guide for the pin so that profile follower assembly 50 slides linearly in the lengthwise direction of the slots in response to force from either the compression spring or the door half strap 20. Compression spring 38 is mounted over a spring guide 39 affixed at one end to the body half strap 30 and at the other end to the spring retainer clip 33. The spring is preferably designed to produce sufficient force on the profile follower assembly 50 to reduce rattling and squeaks, but not so high as to require unacceptably high efforts to move the door. Preferably the slots 37 are axially aligned with and positioned on either side of the compression spring 38. Spacer elements 66, 67 may be used to reduce rattling and vibrational noises. Spacer 66 is positioned between the spring 38 and the door half 20, and spacer 67 is positioned between the spring and the downwardly extending flange 48 of the spring retainer clip 33.

Figure 4:
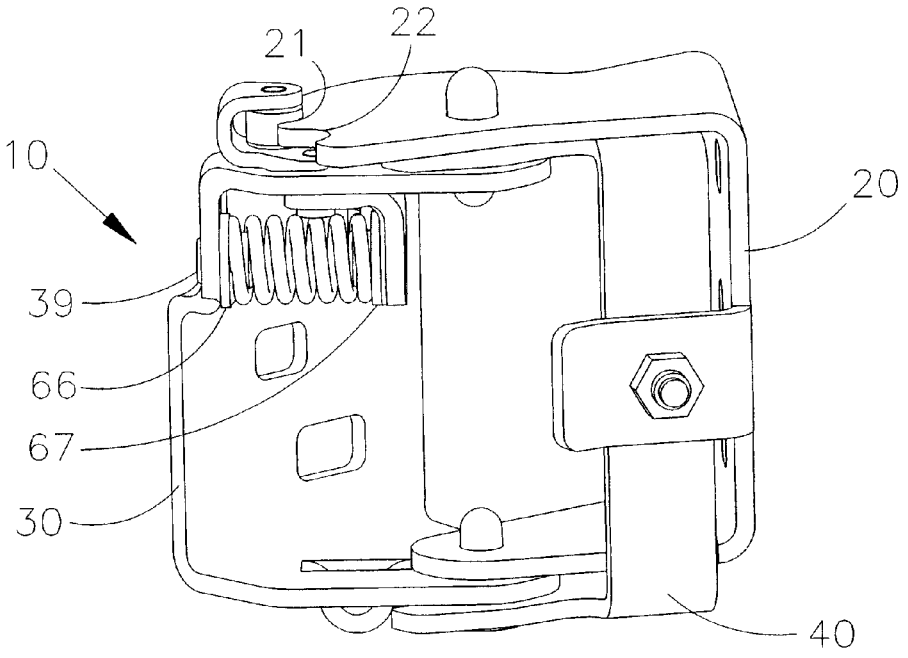
FIG. 4 is a perspective view of the hinge assembly of FIG. 1 in an intermediate position where the door half strap has pivoted so that the roller is seated in the first detent.
Figure 5:
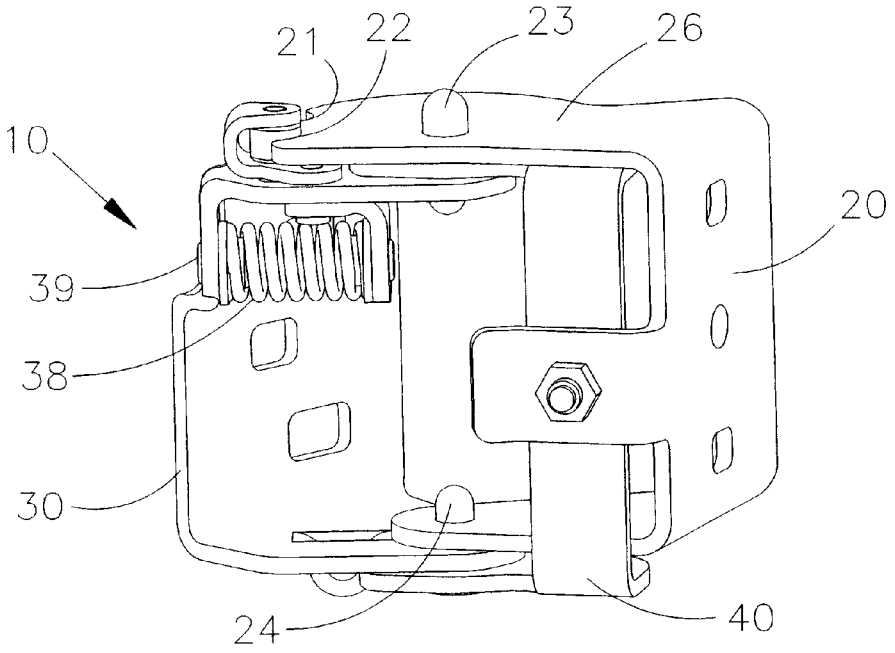
FIG. 5 is a perspective view of the hinge assembly of FIG. 1 in a full open position, where the door half strap has pivoted so that the roller is seated in the second detent.
Figure 6:
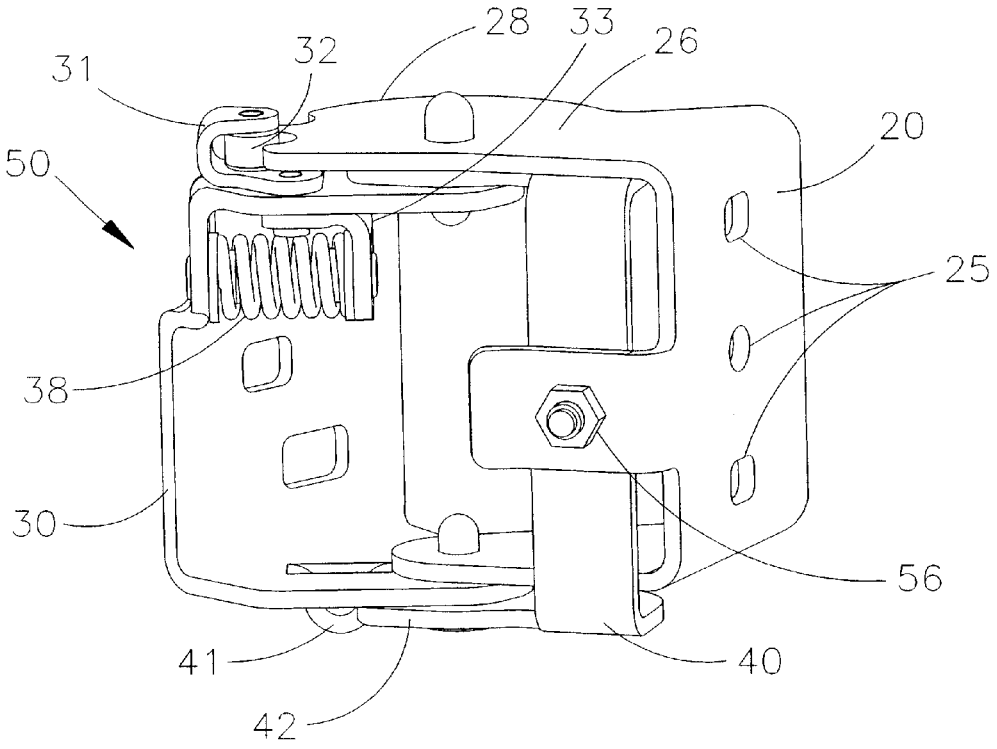
FIG. 6 is a perspective view of the hinge assembly of FIG. 1 in an overtravel position, where the overtravel flange engages the overtravel stop to resist additional pivoting of the door half strap.

Pivoting of the door half strap 20 in response to rotation of a door (not shown) urges the profile past the roller. In FIG. 4 the force of the compression spring 38 urges the roller 32 into the first detent 21. To "climb out" of the detent, that is, to pivot the door half strap so the roller 32 is no longer in detent 21, additional effort must be applied in either direction. Thus, the door advantageously has a tendency to stay in this intermediate open position. Similarly, in FIG. 5, additional pivoting of the door half strap 20 will align the roller 32 in second detent 22, defining a full open position. FIG. 6 shows an over travel position where continued rotation of the door half strap 20 past the full open position allows a flange 42 on a pivot strap 40 to contact an overtravel stop 41, shown in the drawings as an eyebrow notch formed unitary with the body half strap 30. It will be readily apparent to those skilled in the art given the benefit of this disclosure that the overtravel flange may be positioned in the alternative on or as part of the door half strap 20.

Pivot strap 40 can be used for a "doors off" feature. Doors off, as that term is used here, refers to the ability of a hinge assembly to be attached with an appropriate attachment mechanism to both the door and the body, pivotally securing the door to the body, and having a disconnect feature whereby the door half can be separated from the body half without removing the attachment mechanism securing the body half strap to the body and the door half strap to the door. This is considered advantageous in that removal of the door prior to final assembly of a motor vehicle allows access to the interior to install components inside the motor vehicle such as the instrument panel, airbags, etc. The doors off feature also provides the opportunity to install door components and to trim any door seals without interference from the body of the motor vehicle. In the embodiment shown in the drawings, pivot strap 40 is pivotably attached to the body half strap 30 at upper and lower hinge pins 23, 24, and secured to the door half strap 20 by attachment bolt 56. Thus, the door half strap and the body half strap may be welded in place, and then the attachment bolt 56 and hinge pins 23, 24 removed. This allows the door half strap 20 to be separated from the body half strap 30, yet maintains the initial alignment so that the straps may be reassembled with the same positioning relative to one another.

From the foregoing disclosure and detailed description of certain preferred embodiments, it will be apparent that various modifications, additions and other alternative embodiments are possible without departing from the true scope and spirit of the invention. For example, it will be apparent to those skilled in the art, given the benefit of this disclosure, that the depth and slope of the profile near the detents may be modified to produce a different "feel " to the operator of the door, and that more than 2 detents may be used. Also the profile follower assembly and the external profile may be reversed so that the profile follower assembly is linearly slidable on the door half strap and the external profile is part of the body half strap. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A hinge assembly comprising, in combination:

a body half assembly for attachment to a body of a motor vehicle, comprising a body half strap having a top flange and a bottom flange, the top flange having at least one slot;

a door half assembly for attachment to a door of a motor vehicle, comprising a door half strap being pivotable with respect to the body half strap and comprising a top flange and a bottom flange, the top flange having an external profile having at least a pair of detents;

a profile follower assembly linearly slidable on the body half strap, and continuously engaging the external profile as the door half strap pivots with respect to the body half strap, the the profile follower assembly comprising:

a roller retainer clip;

a roller mounted on the roller retainer clip, and directly contacting the external profile;

a compression spring; and a spring retainer clip secured to the roller retainer clip by at least one pin extending through the one slot in the top flange of the body half strap so that the spring retainer clip and the roller retainer clip travel together, wherein the spring extends generally parallel with the top flange of the body half strap so that the spring is axially aligned with the slot and biases the spring retainer clip along the slot toward the door half strap.

2. The hinge assembly of claim 1 wherein the roller retainer clip has a C-shaped portion and a flange extending from the C-shaped portion, the roller is mounted within the C-shaped portion and the pin extends from the flange to a corresponding flange on the spring retainer clip.

3. The hinge assembly of claim 1 wherein the spring is positioned between the body half strap and a downwardly extending flange of the spring retainer clip, and the spring is mounted on a spring guide which is attached to the body half strap.

4. The hinge assembly of claim 1 wherein the door half strap is pivotable from a closed position where the roller contacts the profile, to an intermediate position where one of the detents receives the roller, and then to a full open position where a second of the detents receives the roller.

5. The hinge assembly of claim 4 further comprising an overtravel stop formed as a single unit with the bottom flange of the body half strap, and the door half strap is pivotable to an overtravel position where the overtravel stop restricts additional pivoting of the door half strap.

6. The hinge assembly of claim 4 wherein as the door half strap pivots from one of the detents the door half strap pushes the profile follower assembly to slide in the slot, partially compressing the compression spring.

7. The hinge assembly of claim 1 further comprising means for pivoting the door half strap with respect to the body half strap, comprising an upper hinge pin and a lower hinge pin, each hinge pin being rigidly attached to the door half strap and aligned on the same axis, the upper hinge pin extending into an opening in the top flange of the body half strap and the lower hinge pin extending into an opening in the bottom flange of the body half strap.

8. The hinge assembly of claim 1 further comprising attachment means for securing the door half strap to a door and for securing the body half strap to a body of the motor vehicle.

9. The hinge assembly of claim 8 wherein the body half assembly further comprises a pivot strap pivotably attached to the body half strap, wherein the pivot strap has a bolt for removably securing the pivot strap to the door half strap so that the door half assembly may be removed from the body half assembly without removal of the attachment means of the door half strap and the body half strap.

10. The hinge assembly of claim 1 wherein the at least one slot comprises a pair of slots positioned on either side of the compression spring and aligned generally parallel with one another, and the at least one pin comprises a pair of pins, each pin fitting into a corresponding slot;

wherein the roller retainer clip is mounted above the top flange of the body strap, and the spring retainer clip is mounted below the top flange of the body strap, and each pin connects the roller retainer clip to the spring retainer clip.

11. A hinge assembly comprising, in combination:

a body half assembly for attachment to a body of a motor vehicle, comprising a body half strap having a top flange and a bottom flange, the top flange having a pair of slots;

a door half assembly for attachment to a door of a motor vehicle, comprising a door half strap being pivotable with respect to the body half strap and comprising a top flange and a bottom flange, the top flange having an external profile having at least a pair of detents;

a profile follower assembly linearly slidable on the body half strap, and continuously engaging the external profile as the door half strap pivots with respect to the body half strap, the profile follower assembly comprising a roller retainer clip, a roller mounted on the roller retainer clip, and a spring retainer clip;

a pair of pins, each pin fitting into a corresponding one of the slots; and a compression spring biasing the profile follower assembly toward the door half strap;

wherein the roller retainer clip is mounted above the top flange of the body strap, and the spring retainer clip is mounted below the top flange of the body strap, and each pin connects the roller retainer clip to the spring retainer clip.

* * * * *